US006644644B2

(12) United States Patent
Vedoy

(10) Patent No.: US 6,644,644 B2
(45) Date of Patent: Nov. 11, 2003

(54) SHEET FEEDER DROP TABLE WITH TRANSVERSE TAKE-AWAY CONVEYOR

(75) Inventor: Arild Vedoy, White Bear Lake, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 55 days.

(21) Appl. No.: 10/003,797

(22) Filed: Oct. 26, 2001

(65) Prior Publication Data

US 2003/0080500 A1 May 1, 2003

(51) Int. Cl.[7] ..... B65H 31/04
(52) U.S. Cl. ..... 271/3.03
(58) Field of Search ..... 271/3.03, 171, 271/223

(56) References Cited

U.S. PATENT DOCUMENTS 5,033,729 A * 7/1991 Struthers ..... 271/10.06
5,346,206 A * 9/1994 Steinhart ..... 271/305
6,032,947 A * 3/2000 Parker ..... 271/213
6,050,563 A 4/2000 Vedoy et al. ..... 271/10.07
6,206,363 B1 3/2001 Vedoy et al. ..... 271/176

* cited by examiner

*Primary Examiner*—Donald P. Walsh
*Assistant Examiner*—Kenneth W Bower
(74) *Attorney, Agent, or Firm*—Nikolai & Mersereau, P.A.

(57) ABSTRACT

A sheet tray for a conveyor belt delivery system wherein sheets fed from a sheet feeder are stacked in the sheet tray and then transported from the sheet tray on the conveyor. The sheet tray as two walls at least one of which is movable to hold different sized sheets in a stack. The sheet feeder has two open ends to allow for the transport of stacks by a conveyor belt. The sheet feeder delivers a specified number of sheets to the stack and then stops delivering sheets. The conveyor has a post to engage and move the stack out of sheets off the base of the walls onto the conveyor belt. A sensor on the sheet tray notified the sheet feeder that the sheet tray is empty and to start feeding sheets to a new stack.

14 Claims, 3 Drawing Sheets

SHEET FEEDER DROP TABLE WITH TRANSVERSE TAKE-AWAY CONVEYOR

BACKGROUND OF THE INVENTION

1. Field of the Invention

This invention relates to sheet stacking and delivery by endless belt and more particularly to a sheet tray for receiving sheets from a sheet feeder working in conjunction with a conveyor for removing stacks of sheets from the sheet tray.

2. Description of the Related Art

Sheet feeders such as that described in the applicant's U.S. Pat. No. 6,050,563 issued Apr. 18, 2000, which hereby made a part hereof and incorporated herein by reference, delivers a specified number of sheets to a sheet tray. The stack of sheets must then be removed from the sheet tray. One means of removing the stacks form the tray is a manual removal from the front of the tray which triggers a sensor indicating that the stack has been removed and signals the sheet feeder to send another stack of sheets to the sheet tray. Such a sheet tray is shown in the applicant's U.S. Pat. No. 6,206,363 issued Mar. 27, 2001, which hereby made a part hereof and incorporated herein by reference.

The removal of the sheets from the sheet tray s such as on U.S. Pat. No. 6,206,363, requires a person or robot to remove the stack from the tray and place it someplace.

It is desired to have an endless lug conveyor for removing the stacks form the sheet tray and moving the stacks to a location for packaging or other operations.

SUMMARY OF THE INVENTION

The invention is a sheet tray for use with a sheet feeder and a lug conveyor. The sheet tray receives sheets from the sheet feeder and retains them until a stack of a know quantity of sheets is delivered to the sheet tray. A conveyor chain post then pushes the stack out of the sheet tray and onto a conveyor bed. A sensor on the sheet tray notifies the sheet feeder that the sheet tray is empty and the sheet feeder then begins sending sheets to the sheet tray for another stack.

The sheet tray has two parallel walls for collecting sheets therebetween. The distance between the walls is adjustable. The walls are attached to guide rods and one wall slides relative to the other on the guide rods to adjust for different sized sheets contained therein. The guide rods have brackets attached to one wall and tighten or loosen to move the walls. A sheet guide rod over the stack and attached to one wall provides a top for guiding the sheets from the sheet feeder into the sheet tray. A post on a conveyor chain passes between the two walls and removes the stack from the base of the walls to the conveyor bed. In this manner a continuous movement of stacks of sheets from the sheet tray is provided. This also provides for collating stacks of various materials such as a stack of envelopes from the catch tray on feeder 1 and cards on feeder 2. The envelopes will then pass under the catch tray on feeder 2 while the chain post is pushing the cards off the catch tray on feeder 2.

OBJECTS OF THE INVENTION

It is an object of the invention to provide a continuous removal of stacks of sheets from a sheet tray by use of an endless belt conveyor.

It is an object of the invention to provide an adjustable length and width sheet tray for use with any sized sheets in conjunction with a conveyor belt and a sheet feeder.

Other objects, advantages and novel features of the present invention will become apparent from the following detailed description of the invention when considered in conjunction with the accompanying drawing.

DESCRIPTION OF THE PREFERRED EMBODIMENTS

Figure 1:
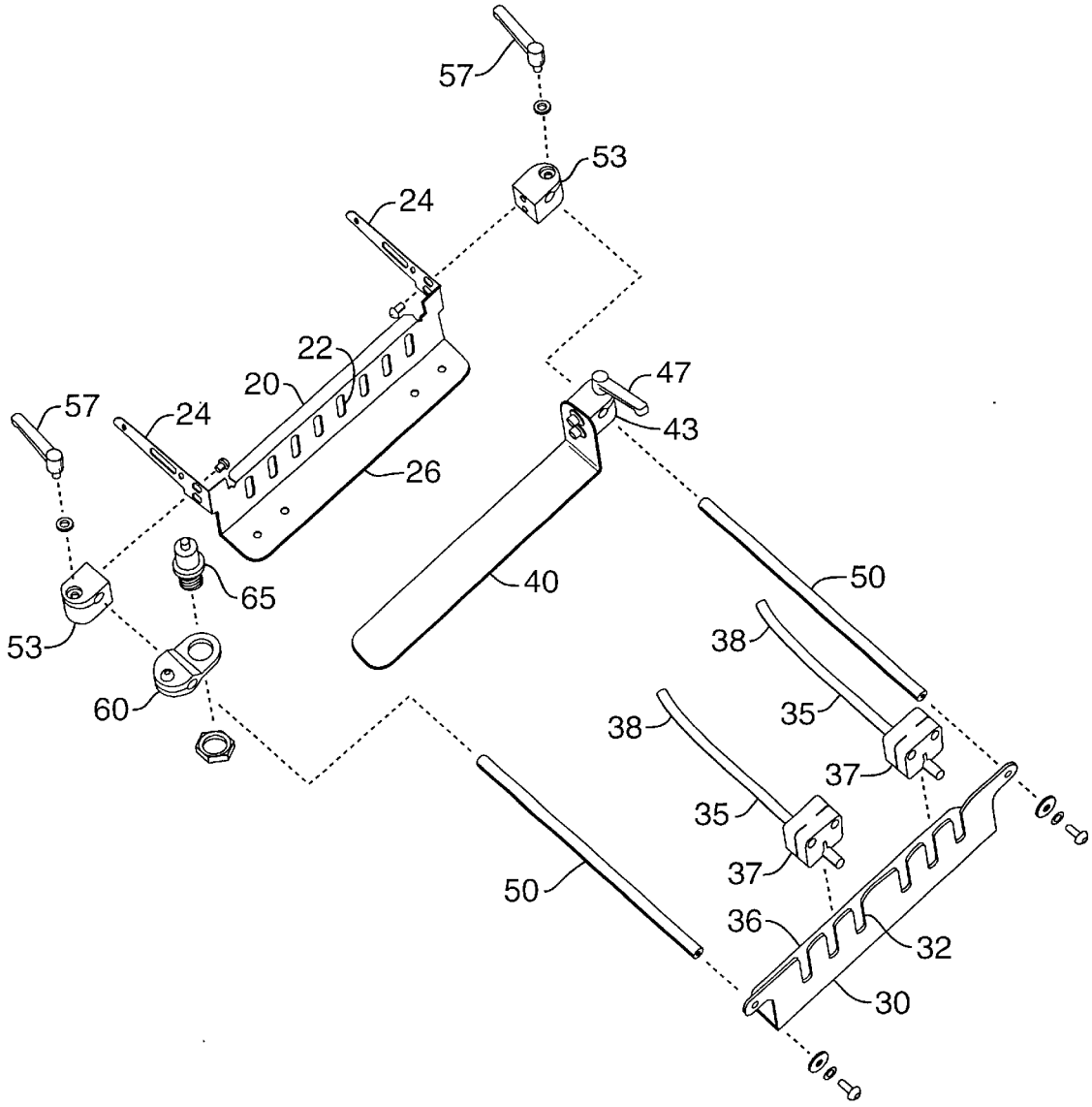
FIG. 1 is an exploded view of the sheet tray.
Figure 2:
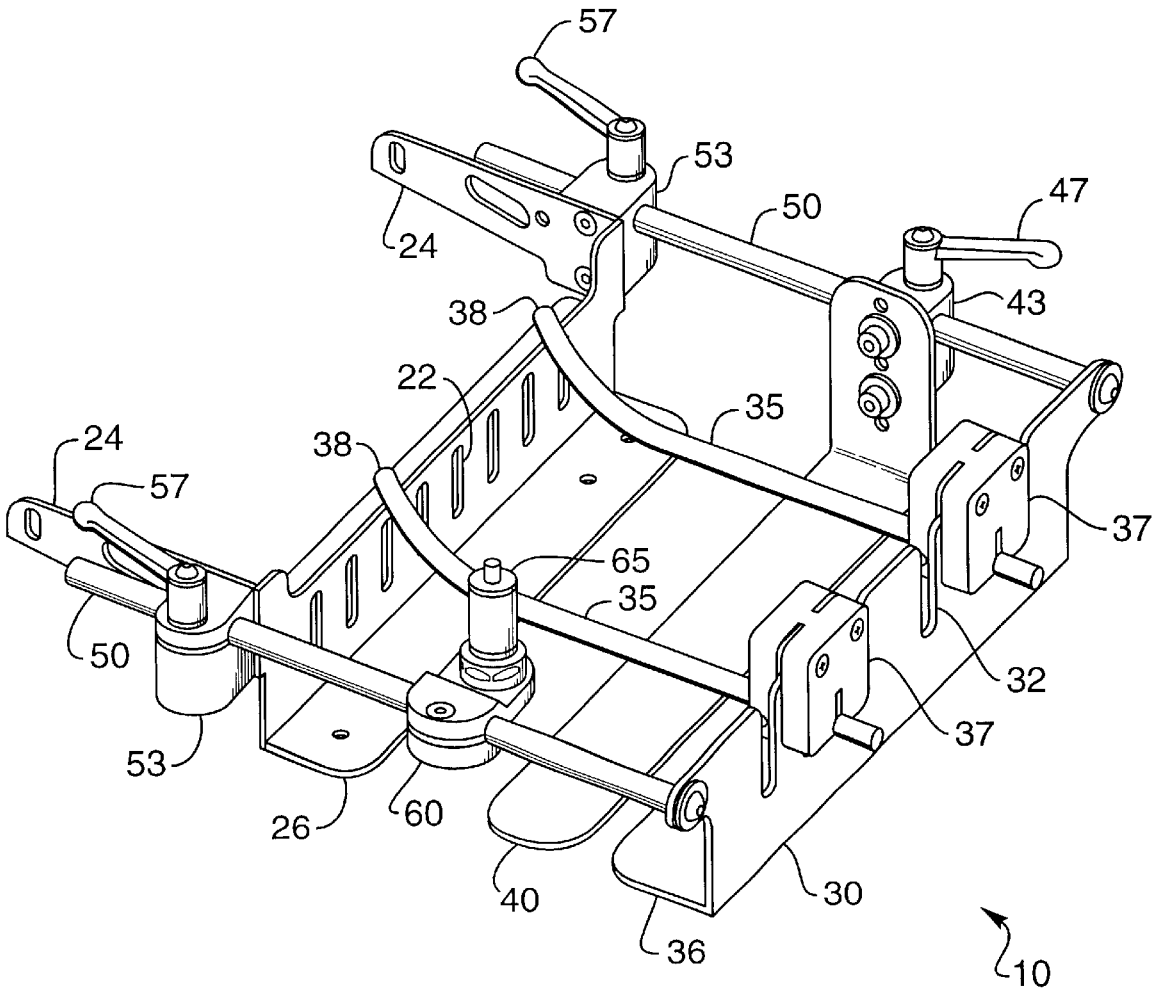
FIG. 2 is a perspective view of an assembled sheet tray.
Figure 3:
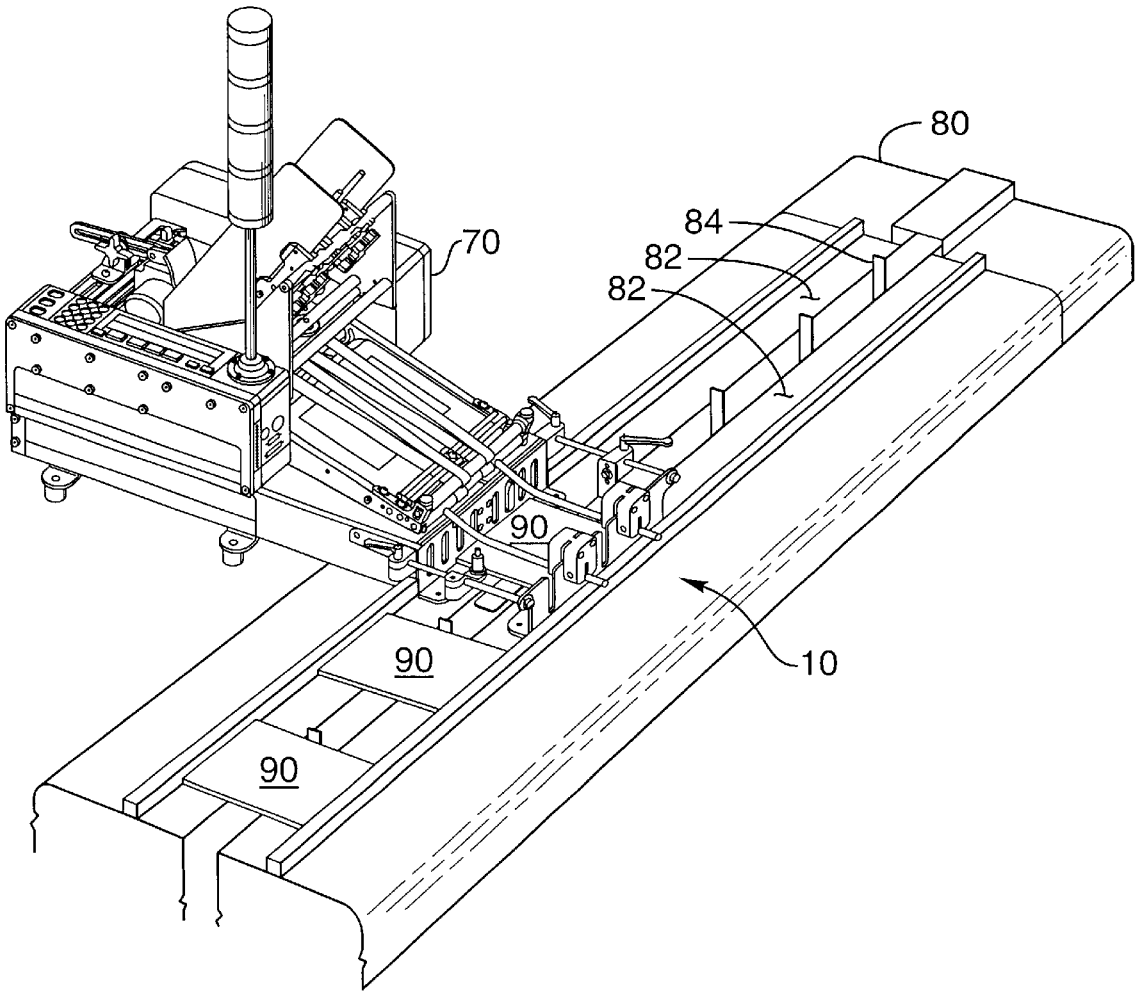
FIG. 3 is a perspective view of a sheet tray in use with a sheet feeder and a conveyor belt.

The sheet tray 10 has a first wall 20 having arms 24 for attaching the sheet tray 10 to a sheet feeder 70. The arms 24 keep the sheet tray 10 in a fixed position so that sheets fed by the sheet feeder will be delivered to the sheet tray 10 in the same position to stack the sheets in the tray. The first wall 20 has a plurality of apertures 22 in the wall to let air escape from between the sheets as the sheets are stacked in the sheet tray 10. The first wall 20 also has a base portion 26 for holding the sheets above the conveyor bed 82 on the conveyor table 80. The arms 24 on the first wall also 20 keeps the bottom portions 26 and 36 of the first and second walls 20 and 30 above the conveyor bed 82 on conveyor table 80.

The sheet tray has a second wall 30, which also has a base portion 36 for holding stacks of sheets 90 above the conveyor bed 82 on conveyor table 80. Guide rods 50 extend between the first wall 20 and the second wall 30. The guide rods 50 can be fixedly attached to the second wall 30 and adjustably attached to the first wall 20 so that the second wall 30 can be moved relative to the first wall 20. One means for adjustably attaching the first wall 20 to the guide rods 50 is by adjustable brackets 53 which can alternatively clamp down on the guide rod 50 or be loosened so that the adjustable bracket 53 can slide thereon. A lever 57 is used to move the adjustable bracket 53 from the locked state to the loose state. The adjustable bracket 53 can be fixedly mounted on the arms 24 of the first wall 20. With the adjustable brackets 53 loosened the second wall 30 can be moved to a desired position to accommodate the size sheet fed into the sheet tray 10. The adjustable brackets 53 can then be tightened on the guide rods 50 to lock the second wall 30 into position.

The second wall can have slots 32 which function to allow air to escape from between the sheets when sheets are added to the stack in the sheet tray 10, and to provide openings for the attachment of guide rods 35 in selected positions. The guide rods 35 are bent upward at one end 38 for receiving sheets beneath the bent up ends and guiding the sheets downward as they enter the sheet tray 10 from the sheet feeder 70. The guide rods 35 extend through slots 32 in the second wall 30 and are fixed into position on the second wall 30 by brackets 37. The brackets 37 can be attached to the second wall 30 at different heights for different height stacks 90.

A sensor support 60 can be attached to the guide rod 50 and positioned over a conveyor belt between the first wall 20 and second wall 30 such that a sensor 65 placed in the sensor support 60 can sense when the sheet tray 10 is empty and send a signal to the sheet feeder 70 to begin filling the sheet tray 10. Thus as the post 84 pushes the stack of sheets 90 on the conveyor table 80 out of the sheet tray 10 the sheet feeder will count out and add another stack of sheets to the sheet tray 10.

If the lug conveyor 82 is left to run at a speed calculated to allow the sheet feeder 10 to add a known number of sheets in each stack 90 the sheet feeder 70 will have time to deliver the sheets to the stack 90 and then shut off waiting for the stack 90 to be removed from the sheet tray 10. When the sheet tray 10 is emptied by the conveyor lug 84 moving the sheets out from the open side of the sheet tray 10 the sensor will tell the sheet feeder 70 to turn on and add another stack of sheets 90 to the sheet tray 10.

The posts 84 on the conveyor table 80 can engage and push the stacks of sheets 90 out of the sheet tray 10 which is open on two sides.

The sheets entering the sheet tray 10 rest on the base portions 26 and 36 of the first and second walls 20 and 30 above the lug conveyor bed 82 until post 84 pushed the stack out of the sheet tray 10.

Since the second wall 30 is adjustable to allow for different size sheets the second wall 30 may be moved away from the first wall allowing the sheets to sag and engage bed 82 on conveyor table 80. In some cases the sheets may need to be supported between the base 26 of the first wall 20 and the base 36 of the second wall 30. An adjustable base 40 is provided which is adjustably attached to a guide rod 50 by adjustable bracket 43 having adjustment lever 47 for engaging or loosening the bracket 43 from guide rod 50.

The adjustable base 40 can then support the sheets between the first and second walls 20, 30 and be able to be adjusted to be out of the way of the posts 84 passing through the center of the sheet tray 10.

Although the first wall 10 is described herein as fixed and the second wall 20 as adjustable either or both walls may be adjustable in other embodiments. The adjustable brackets 43 shown may be of any style such that is easy to adjustably engage the guide rods 50.

Obviously, many modifications and variations of the present invention are possible in light of the above teachings. It is therefore to be understood that, within the scope of the appended claims, the invention may be practiced otherwise than as specifically described.

What is claimed is:

1. A sheet tray comprising:

a first wall and a second wall parallel to the first wall, both walls having base portions perpendicular to the wall and facing each other for supporting articles placed between the walls above a conveyor belt, a guide rod adjustably connecting the first wall to the second wall such that the distance between the walls is adjustable.

2. A sheet tray as in claim 1 having, a pair of arms attached to the first wall for connecting the first wall to a sheet feeding machine such that the sheet feeding machine and the sheet tray remain aligned for receiving sheets.

3. A sheet tray as in claim 1 having, apertures in the first wall for allowing air to escape from between the sheets being added to the stack of sheets in the sheet tray.

4. A sheet tray as in claim 3 having, sheet guide bars attached to the second wall for providing a top guide to sheets entering the sheet tray.

5. A sheet tray as in claim 1 having, sheet guide bars attached to the second wall for providing a top guide to sheets entering the sheet tray.

6. A sheet tray as in claim 1 having, a sensor attached to the guide rod for sensing when the stack of sheets has been removed from the sheet tray.

7. A sheet tray as in claim 1 having, the second wall with slots to place the top guides in and to allow air to escape through the wall from between sheets added to the stack in the sheet tray.

8. A sheet tray as in claim 1 having, an adjustable base portion slideably connected to a guide rod for providing support beneath the sheets in the sheet tray between the bases of the walls.

9. A sheet tray as in claim 4 having, the second wall with slots to place the top guides in and to allow air to escape through the wall from between sheets added to the stack in the sheet tray.

10. A sheet tray as in claim 9 having, an adjustable base portion slideably connected to a guide rod for providing support beneath the sheets in the sheet tray between the bases of the walls.

11. A sheet tray as in claim 9 having, the second wall with slots to place the top guides in and to allow air to escape through the wall from between sheets added to the stack in the sheet tray.

12. A sheet tray as in claim 10 having, a pair of arms attached to the first wall for connecting the first wall to a sheet feeding machine such that the sheet feeding machine and the sheet tray remain aligned for receiving sheets.

13. A sheet tray as in claim 11 having, a pair of arms attached to the first wall for connecting the first wall to a sheet feeding machine such that the sheet feeding machine and the sheet tray remain aligned for receiving sheets.

14. A sheet tray as in claim 13 having, an adjustable base portion slideably connected to a guide rod for providing support beneath the sheets in the sheet tray between the bases of the walls.

* * * * *